United States Patent [19]

Johnston

[11] 4,302,641

[45] Nov. 24, 1981

[54] FLOAT SWITCHES WITH WIDE DIFFERENTIAL

[75] Inventor: Stephen P. Johnston, Detroit Lakes, Minn.

[73] Assignee: S. J. Electro Systems, Inc., Detroit Lakes, Minn.

[21] Appl. No.: 149,194

[22] Filed: May 12, 1980

[51] Int. Cl.[3] ..... H01H 35/18

[52] U.S. Cl. ..... 200/84 R; 200/153 A; 200/61.52; 200/230

[58] Field of Search ..... 200/153 A, 61.46, 61.47, 200/61.48, 61.52, 84 R, 61.45 R, 81.9 HG, 190, 220, 230; 340/623, 625; 73/308, 313, 314, 318, 322.5

[56] References Cited

U.S. PATENT DOCUMENTS

| | | | |
|---|---|---|---|
| 1,972,724 | 9/1934 | White | 200/153 A |
| 2,448,681 | 9/1948 | Nutter | 200/153 A |
| 2,600,659 | 6/1952 | Koch, Jr. | 200/84 R |
| 2,708,226 | 5/1955 | Dixon | 200/153 A |
| 3,259,714 | 7/1966 | Coeur | 200/84 R |
| 3,786,469 | 1/1974 | Massaro | 200/61.52 |
| 3,864,538 | 2/1975 | Paradis | 200/84 B |

*Primary Examiner*—Gerald P. Tolin

*Attorney, Agent, or Firm*—Merchant, Gould, Smith, Edell, Welter & Schmidt

[57] ABSTRACT

Apparatus for increasing the effective differential of a position responsive switch (30) which comprises a mounting plate (43) having an aperture larger than the switch, and stop members (46, 47) carried by the switch for limiting the "tumbling" motion of the switch in the aperture. A second embodiment interposes an intermediate mounting member (56) between the switch (30) and the mounting plate (55), and enables tumbling motion between the switch and the intermediate member as well as between the intermediate member and the mounting plate. The apparatus is shown in a float (29) for use for "pump down" and "pump up" operation.

5 Claims, 10 Drawing Figures

FIG. 1
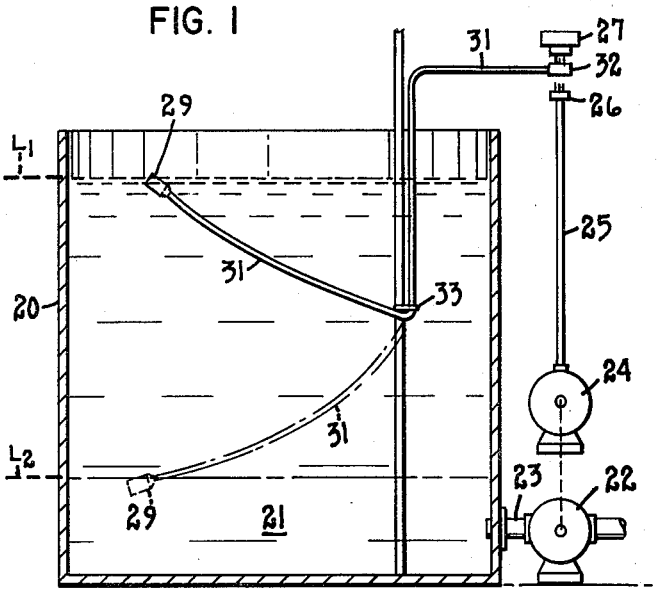
FIG. 8
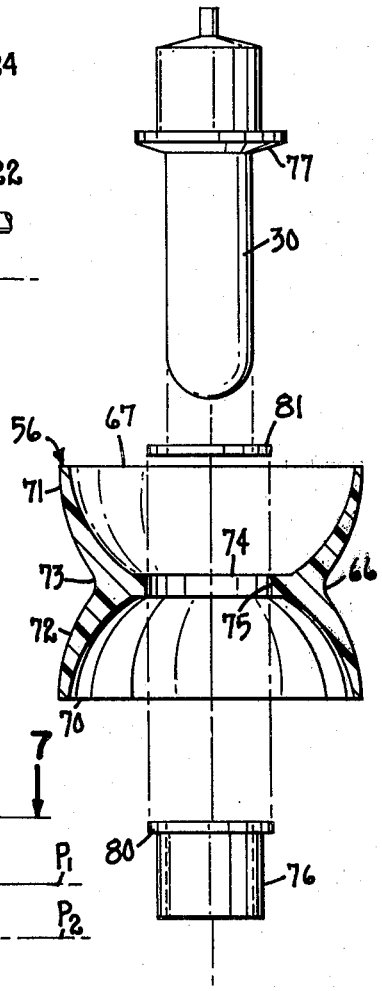
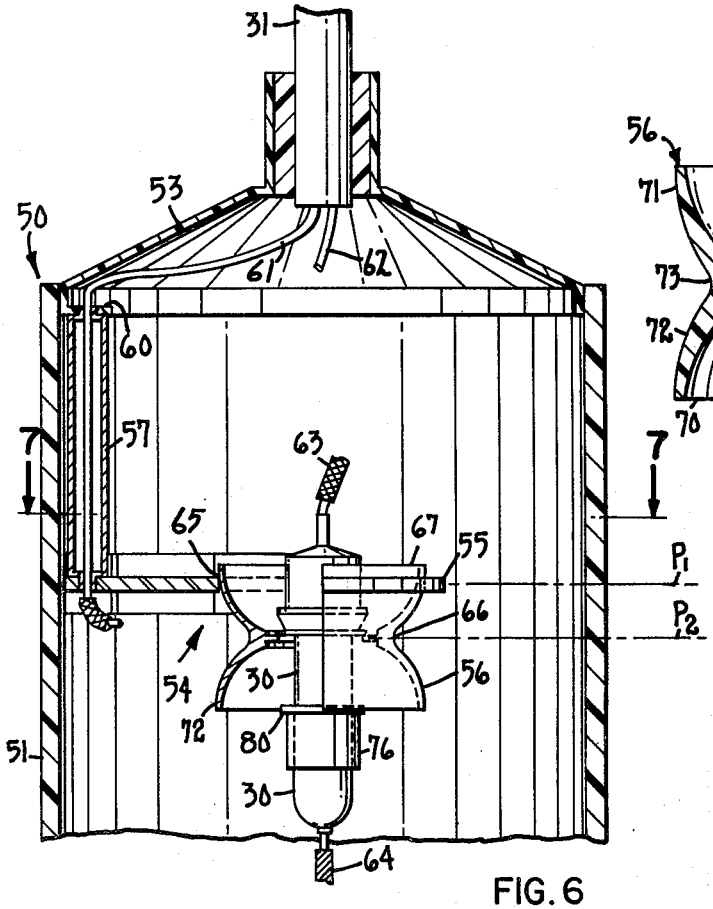
FIG. 6

FLOAT SWITCHES WITH WIDE DIFFERENTIAL

TECHNICAL FIELD

The present invention relates to switching means for riding on the surface of a liquid, so as to energize or deenergize a pump motor, actuate an alarm, or perform some similar electrical monitoring or control function as the liquid level changes. Such devices are known as float switches.

BACKGROUND OF THE PRIOR ART

Numerous types of float switches are known. They may be physically integrated with the devices they control, or physically independent and connected to those devices mechanically or electrically. Again, the float itself may be mechanically connected to the electrical contacting elements, for switching at a site more or less remote from the actual float, or the contacting element may be made a part of a float from which electrical rather than physical connections are extended.

Previous float switches have been characterized by a rather limited range of operation, relatively complicated physical or electrical insulation details, and difficulty of access for repair or maintenance, particularly when the unit to be controlled is in a submerged location.

The limited range of operation is because switches suitable for this use have a quite small "differential", which is to say that there is only a relatively small angular difference between the position in which the switch operates in the "ON" sense and the position in which it operates in the "OFF" sense. A narrow differential is an advantage when it is desired, for example, to hold the level of a liquid in a container as nearly constant as possible, but there are other occasions in which it is permissible to manage a liquid control system so that the liquid is pumped to a first level, the pump is deenergized, and the liquid is allowed to fall or rise to a very different level before pump operation is resumed: examples are filling reservoirs and emptying sumps. In these applications switches having narrow differentials cause repeated brief pump operation at intervals of undesirably short duration.

BRIEF SUMMARY OF THE INVENTION

The present invention relates to float switch structures designed to have a much greater effective differential than the actual differential of the switches themselves. This is accomplished by providing mounting means which allows the switch itself limited motion with respect to the supporting float, so that the spatial relation of the switch with respect to the float is different after actuation in one sense from that after actuation in the opposite sense. To achieve even greater differential, a further embodiment provides an intermediate mounting member, in which the switch has the limited motion just mentioned, and which itself has the same limited motion relative to the supporting float.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals indicate corresponding parts throughout the several views, FIG. 1 shows an application for switches having large differentials;

FIG. 6 is a fragmentary view in longitudinal section of another embodiment of the invention;

FIG. 8 is an exploded fragmentary view of a portion of FIG. 6, parts being shown in section.

DETAILED DESCRIPTION OF A FIRST PREFERRED EMBODIMENT

Figure 2:
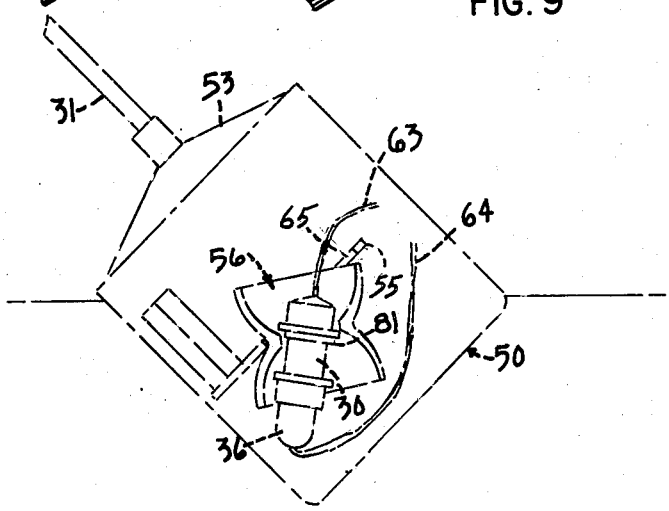
FIG. 2 is an electrical schematic of the switching function performed.
Figure 2:
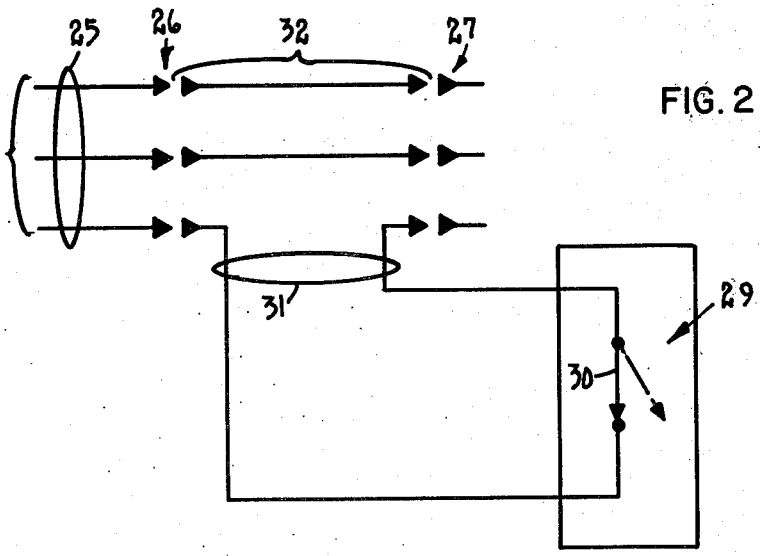

Reference should now be made to FIG. 1, which shows a container 20 in which a liquid 21 is to be maintained between an upper level $L_1$ and a lower level $L_2$. Controlled flow of liquid with respect to container 20 is produced by a pump 22 which may draw liquid from the container through a conduit 23, if the container is for example a sump or drainage vat, or may supply liquid to the container through conduit 23, if the container is for example a standpipe or cistern. Electrical energy is supplied to the motor 24 of pump 22 by a cable 25 having a three-prong plug 26 for energization from a three-wire source at a power receptacle 27. As suggested in FIG. 2, control of motor 24 is exercised by a float 29 containing a switch 30 and connected by a flexible cable 31 to a modified "piggyback" plug 32 adapted to be interposed between plug 26 and receptacle 27, so that switch 30 is in series with one of the power lines to the motor. Cable 31 is secured in container 20 by a suitable clamp 33, at a site generally midway between level $L_1$ and level $L_2$.

When liquid 21 is at level $L_1$, cable 31 extends upwardly from clamp 33, and the axis of float 29 tilts downward from left to right: at liquid level $L_2$, cable 31 extends downwardly from clamp 33, and the axis of the float extends upwardly from left to right.

Figure 3:
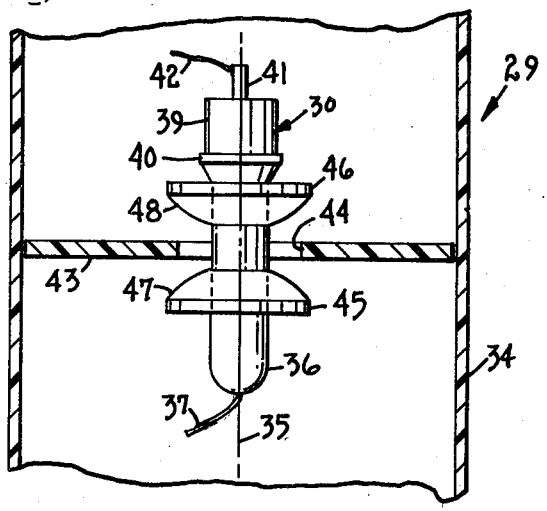
FIG. 3 is a fragmentary plan view of a float switch according to my invention with the housing broken away, showing details of internal construction.

As shown schematically in FIG. 3, float 29 comprises a watertight housing 34 enclosing switch 30, which is of generally cylindrical configuration extending along an axis 35 between a first end 36, to which electrical connection is made directly by a very flexible conductor 37, and a second end 39 having a flange 40 and an insulated electrode 41 to which electrical connection is made by a second very flexible conductor 42. The nature of switch 30 is such that electrical connection is made between conductors 37 and 42 when the switch is positioned so that its axis tilts in a first direction, regardless of the rotated state of the switch about axis 35, and the circuit is broken when the switch is tilted in the opposite direction by more than 13°, which is the angular differential of this particular switch.

A mounting plate 43 is rigidly secured in housing 34 in any suitable fashion, as by cementing, to define a reference plane, and has a central aperture 44 the diameter of which is greater than the diameter of switch 30, so that the switch is a very loose fit in the aperture. Plate 43 is angularly displaceable, with tilting of float 29, in both directions through an intermediate position, tilting of the float of course resulting from the fact that cable 31 is connected thereto at one end and thus exerts a vertical component about the center of gravity of the float. Secured to switch 30 at sites spaced along axis 35 and located on opposite sides of plate 43 are first and second stop members 45 and 46. Members 45 and 46 are of slightly greater diameter than aperture 44, and their apposed faces 47 and 48 may be of generally spherical configuration. Conductors 37 and 42 are for connection to the conductors of cable 31.

OPERATION OF THE FIRST PREFERRED EMBODIMENT

Figure 4:
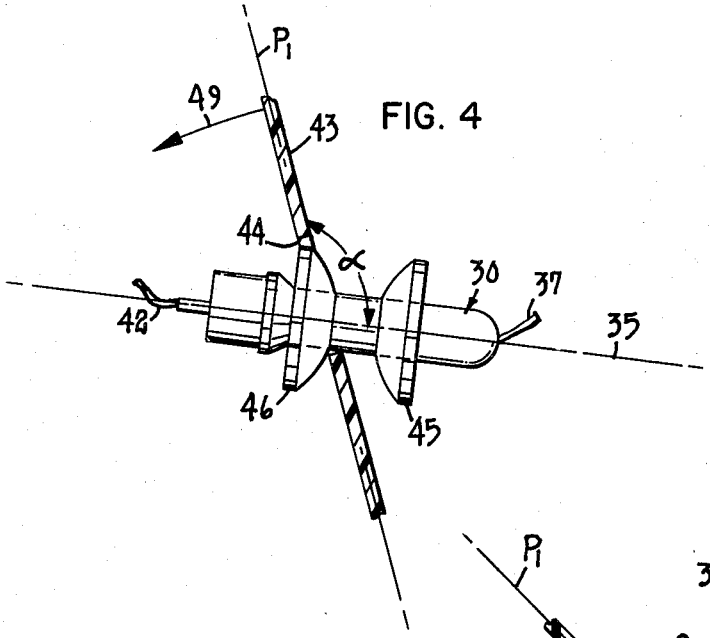
FIG. 4 is a fragmentary view in elevation showing the mechanism of FIG. 3 just before switch operation occurs in a first direction.
Figure 5:
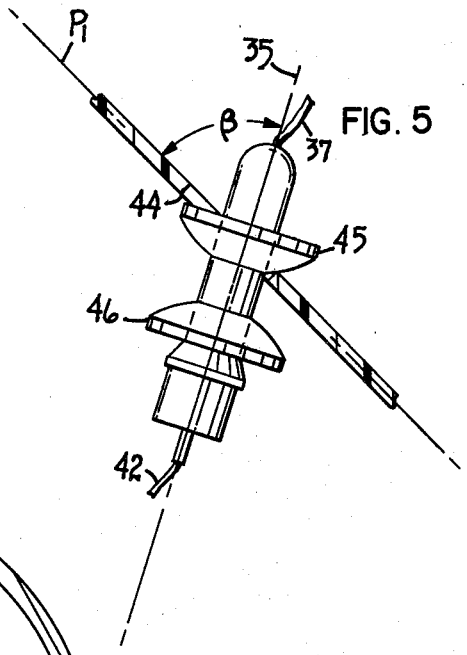
FIG. 5 is a view similar to FIG. 4 showing the mechanism of FIG. 3 just after switch operation occurs.

The operation of my improved float switch will be best understood by referring to FIGS. 4 and 5. Here the level of liquid in the container is assumed to be falling, so that mounting plate 43 is tilting counter-clockwise as suggested by the arrow 49. Switch 30 rests on the bottom of aperture 44. The upper part of stop member 46 projects through the aperture, but the member engages the aperture wall laterally at points above the center of the aperture and prevents the switch from sliding through the aperture to the right. Axis 35 of switch 31 makes an angle $\alpha$ with a reference plane $P_1$ defined by the mounting plate.

This general attitude of the parts is maintained by gravity action on the mass of the switch: the center of gravity of this mass is to the right of the reference plane but approaches that plane as the liquid level drops and the float continues to tilt.

When the center of gravity of the switch passes through the reference plane a sudden change in the parts occurs, to that shown in FIG. 5, where the angle between the switch axis and the reference plane is now $\beta$. The switch has moved bodily, the motion having a linear component, to the left along axis 35, and also having a large angular component, with respect to the reference plane, of magnitude $\alpha$-$\beta$, thus increasing by this angle the tilt required of plate 43 and therefore of float 29 before reverse action of the switch takes place.

It will be readily apparent that when liquid level rises to $L_1$, and float 29 tilts in the opposite direction, an opposite compound motion of switch 30 again takes place, so that the differential of the switch is again changed, this time in the opposite sense, the angle changing from a value $\beta$ to a value $\alpha$.

The motion of switch 30 in plate 43 may be conveniently referred to by the word "tumbling", since the motion is completely free, in response to gravity, except for the limits set by stop members 45 and 46 and the negligible effect of conductors 37 and 42.

DETAILED DESCRIPTION OF A SECOND PREFERRED EMBODIMENT

The structure described above gives considerable increase in the effective differential of a float switch. However, there are occasions when a greater effective differential is needed than even that structure can provide, and FIGS. 6–10 show the details of a structure useable in such applications.

Here a float 50 comprises a closed housing 51 enclosing a switch 30. Housing 51 is closed by an end cap 53 through which cable 31 passes in sealed relation. Mounting means 54 for switch 30 is shown to comprise a mounting plate 55 and an intermediate mounting member 56. Plate 55 is carried by a pair of mounting pillars 57, 58, secured at first ends to plate 55, and at second ends to an inward lip 60 of cap 53. Pillars 57 and 58 are hollow, and the conductors 61 and 62 of cable 31 are extended therethrough for connection to switch 30 by extremely flexible conductors 63 and 64. Plate 55 has an aperture 65 to receive member 56 and switch 30, and defines a first reference plane $P_1$.

Member 56, see FIG. 8, is hollow, and has externally a generally hourglass configuration, extending along a longitudinal axis in both directions from a site 66, of minimum diameter smaller than aperture 65, toward ends 67, 70, of diameter larger than aperture 65. The ends of member 56 may conveniently comprise convex spherical surfaces 71 and 72, joined by a smooth concave surface 73.

Member 56 further includes a transverse internal partition 74 defining a second reference plane $P_2$, and having an aperture 75 of larger diameter than switch 30, so that the switch is a very loose fit in the aperture. A stop member 76 is secured to switch 30 at a site axially spaced from flange 77 and on the opposite side of partition 74 therefrom: it includes a collar 80 of diameter smaller than that of partition 74, but greater than that of aperture 75. A flat washer 81 of comparable diameter may be provided on switch 30 on the same side of partition 74 as flange 77.

By the foregoing arrangement it is evident that switch 30 is capable of limited motion, with respect to member 56, having a linear component orthogonal to plane $P_2$ and angular components in planes orthogonal to plane $P_2$, and that member 56 itself is capable of limited motion with respect to plate 55, having a linear component orthogonal to plane $P_1$, and angular components in planes orthogonal to plane $P_1$.

In other words, switch 30 can tumble in member 56, and member 56 can tumble in plate 55. The actual relative positions of these members after a tumble is not necessarily exactly the same from occurrence to occurrence, axially, angularly, or in rotation about the axes of switch 30 and member 56, and indeed may shift during the movement of the float resulting from the switch operation. It is evident that widened effective switch differential is obtained at the expense of exact repeatability of operation: this is of course true to a lesser extent in the simpler structure of FIGS. 1–5.

OPERATION OF THE SECOND PREFERRED EMBODIMENT

Figure 9:
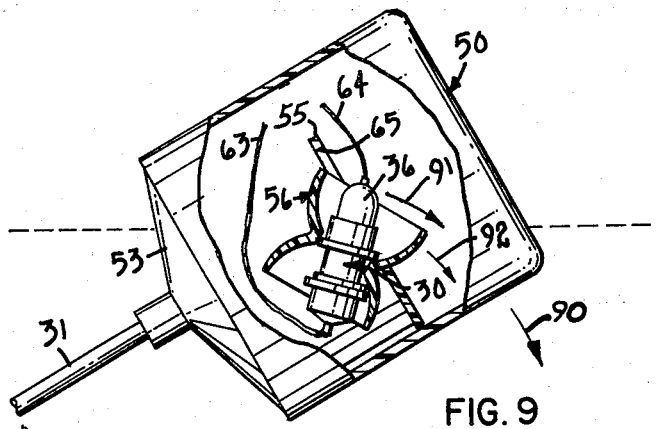
FIGS. 9 and 10 show the second embodiment in use.
Figure 10:
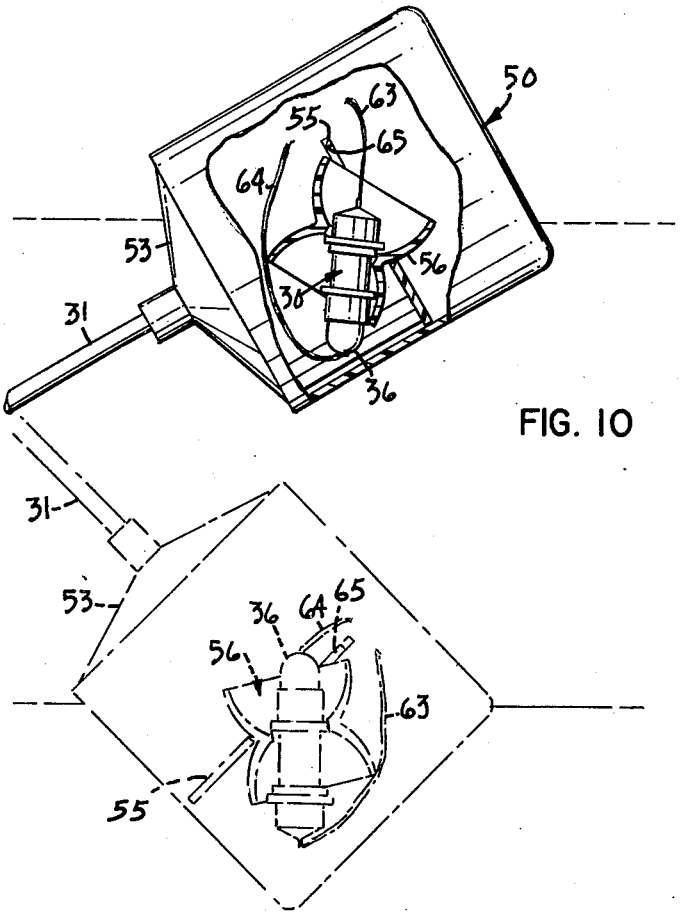
Figure 7:
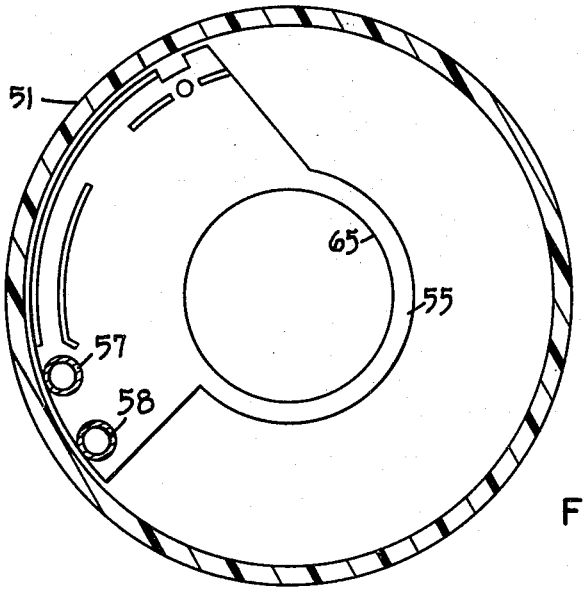
FIG. 7 is a view of the second embodiment in transverse section generally along the line 7—7 of FIG. 6, parts being removed for clarity of illustration.

Attention is now directed to FIGS. 9 and 10, which show the structure of FIGS. 6–8 in two different applications. In FIG. 9 the arrangement is that to be used in a "pump down" mode, in which it is desired to pump liquid from container 20 of FIG. 1 when the liquid rises to an upper level $L_1$, terminating pumping operation when the liquid reaches a lower level $L_2$, precision in either level being of no particular importance. Similarly, FIG. 10 shows an arrangement used in a "pump up" mode, in which it is desired to pump liquid into container 20 when the liquid falls to a low level $L_2$, terminating pumping operation when the liquid rises to an upper level $L_1$, precision at either level again being of no particular significance. It is to be understood, however, that no variation of any significance occurs in either level $L_1$ or $L_2$ during repeated operation of the system in either mode.

FIG. 9 shows in solid lines the state of float 50 just after a liquid level $L_1$ has been attained and tumbling of switch 30 and member 56 have occurred to energize the pump motor. Once switch 30 is in the position shown, the connection between conductors 63 and 64 is completed. Member 56 is resting on the bottom of aperture 65, the end 72 of member 56 projecting partially through the aperture. Switch 30 is resting on the bottom of aperture 75, and stop member 76 is engaging partition 74.

As the liquid level falls in the container, the float tilts in the direction of arrow 90, and switch 30 and member 56 may change their relative positions in plate 55 slightly, as suggested by arrows 91 and 92, the axis of switch 30 always remaining slanted so that end 36 of the switch is uppermost. When the level of the liquid approaches $L_2$, however, tumbles of switch 30 and member 56 both occur, in the directions of arrows 91 and 92, and a new condition is achieved as shown in broken lines in FIG. 9. Here end 36 of switch 30 is downward, so that the switch interrupts the circuit between conductors 63 and 64. Member 56 is supported on the bottom of aperture 65, the end 71 of the member projecting through the aperture. Switch 30 is resting on the bottom of aperture 75 and washer 81 is engaging partition 74. This general situation prevails until the liquid level rises to $L_1$, when the reverse tumbling operation occurs to energize the pump motor.

The operation of the arrangement in the "pump up" mode differs only in that switch 30 is inserted into member 56 in the opposite direction, so that end 36 of the switch is in end 71 of member 56. Under these conditions, as shown in solid lines in FIG. 10, energization of the pump has been cut off as the liquid is raised to level $L_1$, and pump operation will be initiated again when the liquid falls to the level $L_2$.

From the foregoing it will be evident that the invention comprises a method and apparatus for increasing the effective differential of a position responsive switch, by mounting the switch in a manner which enables it to tumble in each direction of operation, and that even greater effective differential is made possible when the switch is mounted for tumbling in an intermediate mounting member which itself is enabled to tumble in the principal mounting member.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In combination:

switch means elongated along an axis, for performing a circuit making and breaking function in accordance with tilting of said switch means and axis in opposite directions;

mounting means defining a reference plane and having an aperture, of greater diameter than the transverse dimension of said switch means, through which said switch means extends in transverse supported relation for motion having a linear component orthogonal to said reference plane and angular components in planes orthogonal to said reference plane;

means carried by said switch means on opposite sides of said reference plane and spaced along said axis for engaging said mounting means to limit said components of motion of said switch means;

said mounting means comprises an outer mounting plate, and an intermediate mounting member, traversed by said switch means, said intermediate member comprising a hollow body of generally hour-glass external configuration, extending along a further axis in both directions from a site of minimum transverse dimension, and including a central transverse partition defining a first reference plane and having an axial aperture, of greater diameter than the transverse dimension of said switch means, through which said switch means extends in transverse supported relation for motion having said components relative to said reference plane and limited by the axially spaced means; and, said mounting plate defining a second reference plane and having a second aperture, of greater diameter than said minimum dimension and of less diameter than the maximum transverse dimension of said intermediate member, through which said intermediate member extends in transverse supported relation for movement having a limited linear component orthogonal to said second reference plane and a limited angular component in any plane orthogonal to said second reference plane.

2. A position responsive switching apparatus comprising:

switch means having a longitudinal axis for making and breaking an electrical circuit in response to tilting of said switch means and axis in opposite directions;

mounting means carried within said apparatus, said mounting means including a planar portion having an aperture, of greater diameter than the transverse dimension of said switch means, through which said switch means extends in supported relation for motion having a linear component orthogonal to said planar portion and an angular component in planes orthogonal to said planar portion; and, axially spaced means affixed to said switch means on opposite sides of said planar portion for engaging said mounting means and for limiting the movement of switch means longitudinally within said mounting means, so that said switch means is free to tilt in any direction regardless of the orientation of said mounting means.

3. A position responsive switching apparatus comprising:

switch means elongated along an axis, for performing a circuit making and breaking function in accordance with tilting of said switch means and axis in opposite directions;

mounting means having a planar portion having an aperture, of greater diameter than the transverse dimension of said switch means, through which said switch means extends in transverse supported relation for permitting said switch means to have motion having a linear component orthogonal to said planar and angular components in planes orthogonal to said planar portion; and, means carried by said switch means on opposite sides of said planar portion and spaced along said axis for engaging said mounting means to limit said components of motion of said switch means.

4. The combination of claim 3 in which said mounting means comprises a mounting plate angularly displaceable through an intermediate position with tilting of the support.

5. The combination of claim 3 further including a liquid-tight float, means securing said mounting means in said float, and cable means connected to said switch means and passing in sealed relation through one end of said float.

* * * * *